US009567777B1

(12) United States Patent
VandenBrink

(10) Patent No.: US 9,567,777 B1
(45) Date of Patent: Feb. 14, 2017

(54) INERTIAL BLOCKING MEMBER SUBASSEMBLY WITH NEGATIVE-ACCELERATION INERTIAL BLOCKING MEMBER ACCELERATOR

(71) Applicant: Eric Allyn VandenBrink, Holland, MI (US)

(72) Inventor: Eric Allyn VandenBrink, Holland, MI (US)

(73) Assignee: ADAC PLASTICS, INC., Grand Rapids, MI (US)

( * ) Notice: Subject to any disclaimer, the term of this patent is extended or adjusted under 35 U.S.C. 154(b) by 293 days.

(21) Appl. No.: 14/094,955

(22) Filed: Dec. 3, 2013

Related U.S. Application Data

(60) Provisional application No. 61/732,482, filed on Dec. 3, 2012.

(51) Int. Cl.

| | |
|---|---|
| ***E05B 3/00*** | (2006.01) |
| ***E05B 77/06*** | (2014.01) |
| ***E05B 77/04*** | (2014.01) |
| ***E05B 77/02*** | (2014.01) |
| *E05B 1/00* | (2006.01) |

(52) U.S. Cl.
CPC ..... *E05B 77/06* (2013.01); *E05B 77/02* (2013.01); *E05B 77/04* (2013.01); *Y10S 292/22* (2013.01)

(58) Field of Classification Search
CPC ..... E05B 77/02; E05B 77/04; E05B 77/06; Y10S 292/22
USPC ..... 292/336.3
See application file for complete search history.

(56) References Cited

U.S. PATENT DOCUMENTS

| | | | | |
|---|---|---|---|---|
| 6,575,508 | B2 * | 6/2003 | Stuart | E05B 77/06 292/336.3 |
| 7,303,217 | B2 * | 12/2007 | Savant | E05B 77/06 16/412 |
| 8,840,156 | B2 * | 9/2014 | Savant | A47B 47/0008 292/336.3 |
| 8,894,108 | B2 * | 11/2014 | Corwin | E05B 77/06 292/336.3 |
| 9,151,090 | B2 * | 10/2015 | Beck | E05B 77/06 |

(Continued)

FOREIGN PATENT DOCUMENTS

| | | | | |
|---|---|---|---|---|
| FR | EP 1586727 A1 * | 10/2005 | | E05B 77/02 |
| FR | EP 1605122 * | 12/2005 | | |
| JP | WO 2014203930 A1 * | 12/2014 | | E05B 77/06 |

*Primary Examiner* — Carlos Lugo
(74) *Attorney, Agent, or Firm* — Dickinson Wright PLLC

(57) ABSTRACT

An inertial blocking member subassembly includes an inertial blocking member associated with a release handle assembly framework, the blocking member having a center of gravity which is offset from an axis of rotation, and the blocking member being rotationally and/or translationally movable between an at-rest position, in which the blocking member does not prevent actuation of the release handle, and an engaged position, in which the blocking member prevents actuation of the release handle. An accelerator body, freely mounted relative to the inertial blocking member for rotational movement about the axis of rotation, has a center of gravity which is offset from both the axis of rotation and center of gravity of the inertial blocking member. As a result of a negative acceleration force acting on the accelerator body center of gravity, the accelerator body rotates about the axis of rotation and carries the blocking member toward the engaged position thereof.

19 Claims, 14 Drawing Sheets

(56) References Cited

U.S. PATENT DOCUMENTS

2011/0115240 A1* 5/2011 Muller ..... E05B 77/06
292/336.3

* cited by examiner

INERTIAL BLOCKING MEMBER SUBASSEMBLY WITH NEGATIVE-ACCELERATION INERTIAL BLOCKING MEMBER ACCELERATOR

CROSS-REFERENCE TO RELATED APPLICATION

The present application is a non-provisional filing of U.S. Provisional Application No. 61/732,482, filed 3 Dec. 2012, the disclosure of which application is incorporated herein by reference in its entirety.

FIELD OF THE INVENTION

The invention relates to vehicle door release handle assemblies incorporating inertial blocking subassemblies for preventing the unintended opening of the vehicle door in the event of an impact, and more particularly to such subassemblies as are capable of actuation during the negative acceleration phase immediately following the impact event.

BACKGROUND OF THE INVENTION

Vehicle door latch assemblies frequently incorporate a door handle assembly with a release handle that is pulled away from the door in order to operate the latch mechanism and open the door. In the case of an impact event such as a collision, particularly one that generates an impact force vector perpendicular to the side of the vehicle, the acceleration of the vehicle in the direction of the side-acting force vector can cause the release handle to pull away from the door, thereby inadvertently actuating the latch mechanism.

As shown in the graph of FIG. 1, impact events such as those described above are characterized by a positive acceleration phase 1 preceded by an initial negative acceleration phase 2 of about 5 msec in duration. The positive acceleration phase corresponds to a period of time when the impact force is directed inwardly toward the door, while the negative acceleration phase corresponds to a preceding period of time, immediately following the impact event, when the impact force is initially translated to a net vector directed outwardly away from the door; i.e., a negative acceleration.

In order to minimize the potential for unintended, impact-induced door opening, vehicle-door release-handle suppliers have developed inertial blocking member subassemblies that impede the unintended movement of the release handle assembly and/or door opening actuator resulting from an impact to the vehicle. These subassemblies are activated between an at-rest position, wherein the door, if functional, can be opened by operating the release handle, and a blocking position, wherein opening of the door is prevented by impact-generated forces. Impeding the movement of the release handle assembly or door opening actuator can thus be accomplished by controlling impact-based acceleration and inertial effects associated with the inertial blocking member subassembly.

Known inertial blocking member subassemblies are configured, generally with a biasing element, to return to the at-rest position, thus enabling the door to be opened in the usual manner in after an impact event.

However, known inertial blocking member subassemblies are only effective during the positive acceleration phase. This is due to the fact that the principle of operation of most conventional inertial blocking member subassemblies is based upon a freely-rotating mass defining an offset (relative to an axis of rotation of the inertial blocking member between the at-rest and blocking positions) center of gravity, which mass is moved by the positive acceleration force of an impact event to carry the blocking member from the at-rest position to the blocking, or engaged, position. Consequently, there exists the potential for conventional inertial blocking subassemblies to fail to respond rapidly enough to the onset of the positive acceleration phase to prevent the release handle from pulling away from the door and inadvertently actuating the latch mechanism.

SUMMARY OF THE INVENTION

There is disclosed an inertial blocking member subassembly for a vehicle-door release handle mechanism including a release handle framework supporting a bell crank actuator and a manually actuatable door handle grip, the door handle grip operatively coupled to the bell crank actuator. The inertial blocking member subassembly comprises: an inertial blocking member associated with the release handle assembly framework, the blocking member having a center of gravity which is offset from an axis of rotation, and the blocking member being rotationally and/or translationally movable between an at-rest position, in which the blocking member does not prevent actuation of the release handle, and an engaged position, in which the blocking member prevents actuation of the release handle; and an accelerator body freely mounted relative to the inertial blocking member for rotational movement about the axis of rotation, the accelerator body having a center of gravity which is offset from both the axis of rotation and center of gravity of the inertial blocking member. As a result of a negative acceleration force acting on the accelerator body center of gravity, the accelerator body rotates about the axis of rotation and carries the blocking member toward the engaged position thereof; while, as a result of a positive acceleration force acting on the blocking member center of gravity, the blocking member is rotationally and/or translationally moved into the engaged position thereof.

In one form the blocking member is characterized in that, in the engaged position thereof, the center of gravity of the blocking member is approximately aligned with the vector of the positive acceleration force and the axis of rotation of the blocking member.

Per one feature of the present invention, the blocking member intercepts and prevents activation of the bell crank actuator when the blocking member is in the engaged position, and permits activation of the bell crank actuator when the blocking member is in the at-rest position. In one form, this may be accomplished by the blocking member including an interference portion which extends into the path of travel, and contacts an interference finger, of bell crank actuator in the engaged or blocking position of the blocking member to thereby prevent rotation of the bell crank actuator.

Per another feature, a blocking member retainer may be provided on at least one of the release handle framework and the blocking member. By reason of the blocking member retainer, the blocking member is retained in the engaged position until disengagement of the blocking member retainer from the at least one of the release handle assembly framework and the blocking member. The blocking member retainer may, in one form, comprise each of a projection provided on one of the release handle framework or the blocking member, and a recess provided on the other of the release handle framework or the blocking member, the projection being at least partially received in the recess in the engaged position of the blocking member.

According to another feature of the present invention, disengagement of the blocking member retainer from the at least one of the release handle assembly framework and the blocking member is effected by operating the release handle assembly. In one form, a biasing member is provided which biases the blocking member into the engaged position thereof. Disengagement of the blocking member retainer from the at least one of the release handle assembly framework and the blocking member may be effected by operating the release handle assembly and, through the combined action of actuation of the door handle grip and the bias of the helical torsion spring, the blocking member engagement feature is disengaged from the recess and, concurrently, the blocking member is returned to the at-rest position.

In another aspect of the present invention, the blocking member may be mounted on a pin or axle and freely rotatable thereon between the at-rest position and the engaged position. The pin or axle may be configured so as to extend between opposite support features provided on the release handle framework.

According to one aspect of the present invention, the blocking member is movable in both rotational and translational directions between the at-rest position and the engaged position.

Per another aspect, the blocking member accelerator includes arms projecting radially outwardly in the same direction, each arm having one of coaxial openings which are dimensioned to receive the pin or axle therethrough.

According to a still further feature, the blocking member accelerator body may be a generally cylindrically-shaped member.

Per another feature, the blocking member accelerator body includes a projection along its principal length, the projection extending outwardly from the surface of the body and positioned so as to abut an opposing portion of the blocking member. Also according to this feature, the blocking member may include a planar portion extending radially away from the rotational axis thereof, the planar portion having a peripheral edge that curves inwardly to define a contact surface for the projection when, as a result of a negative acceleration force acting on the accelerator body center of gravity, the accelerator body rotates about the axis of rotation and carries the blocking member toward the engaged position thereof.

WRITTEN DESCRIPTION

Figure 2:
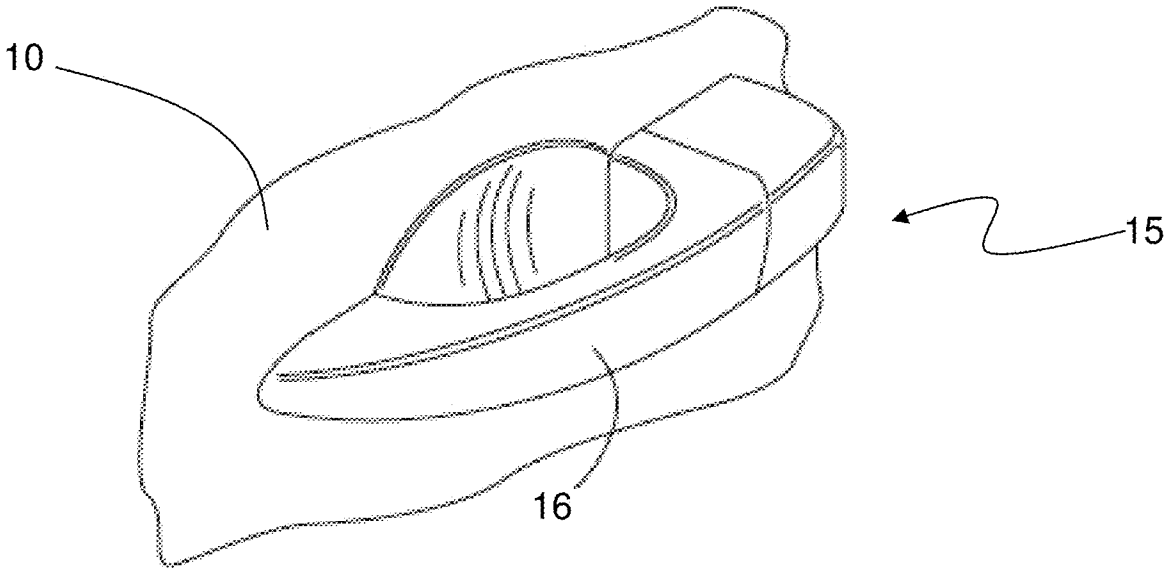
FIG. 2 is a perspective view of a detailed section of a vehicle door, showing the externally disposed portions of the release handle assembly.
Figure 3:
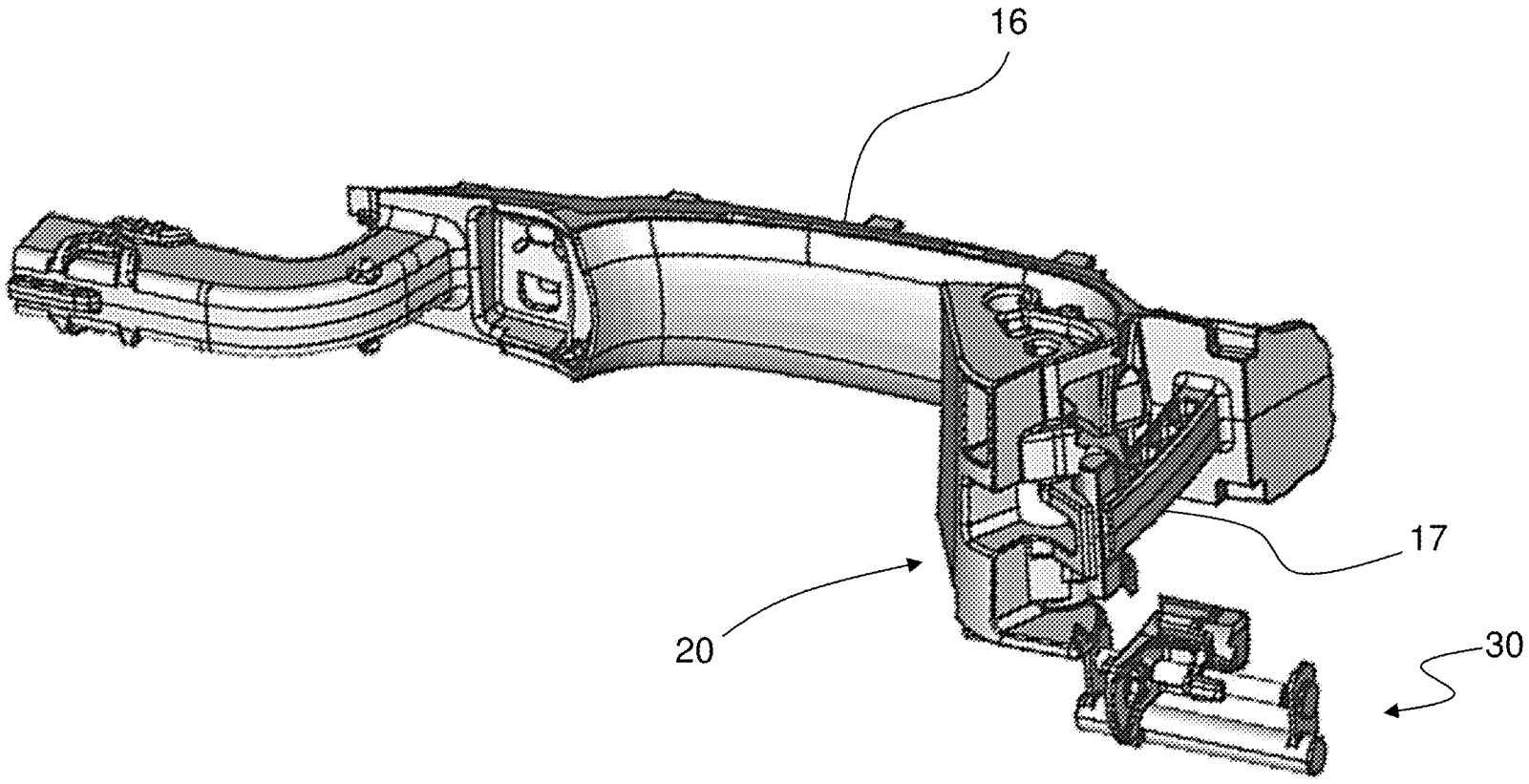
FIG. 3 is a perspective view of the release handle, bell crank actuator and inertial blocking member components of a release handle assembly according to the present disclosure.
Figure 4:
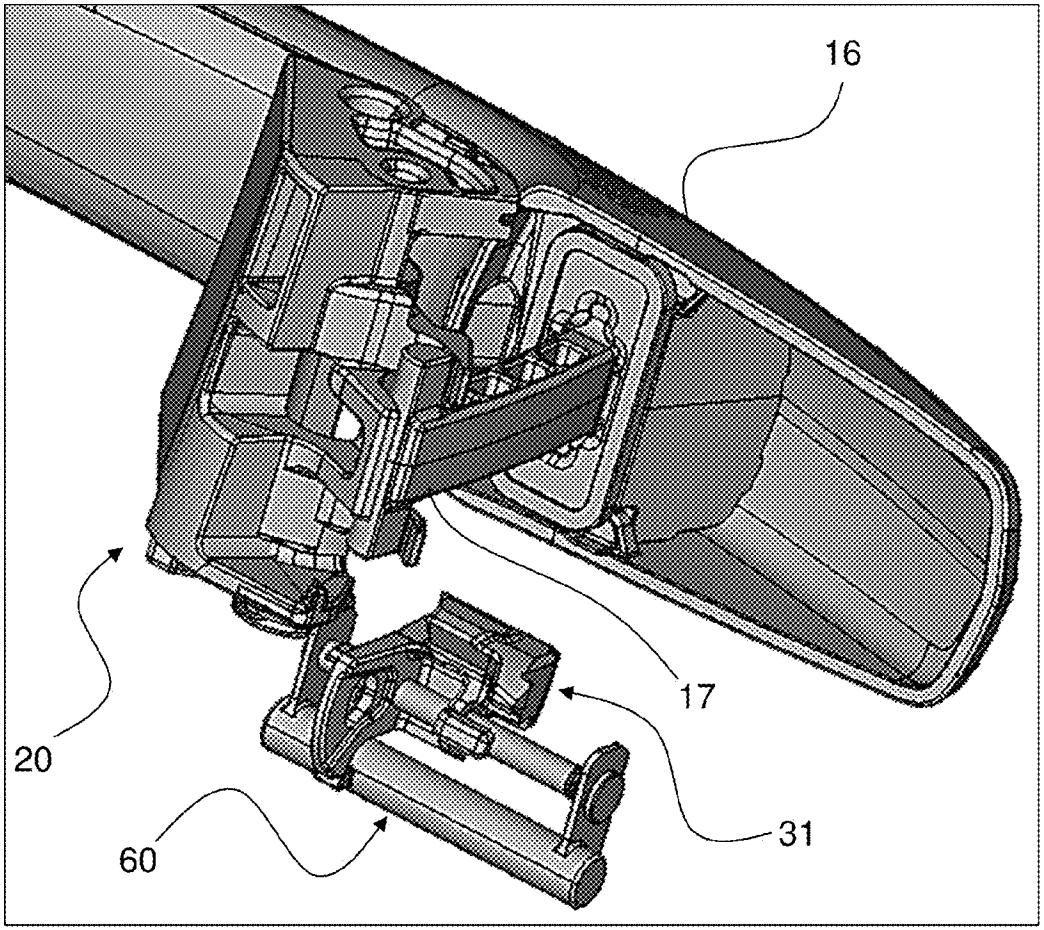
FIG. 4 is a detailed perspective view of the isolated release handle assembly components of FIG. 3.

Referring to the drawings (which are not necessarily to scale), and in particular to FIGS. 2 through 4, a section of a motor vehicle door 10 comprising a door handle assembly 15 is illustrated. Per convention, the door handle assembly 15 has a release handle 16 which can be selectively pulled away from the door to actuate a latch mechanism disposed within the door (not shown) for unlatching, and thus opening, the door 10. More particularly, and also per convention, the release handle 16 is operatively connected, via a stem portion 17, to a bell crank actuator 20 that is rotationally moved upon actuation of the release handle 16. Rotational movement of the bell crank actuator 20, in turn, effects movement of a latch rod (not depicted) operatively coupled to the bell crank actuator. The latch rod is operatively connected at an opposite end to a latch mechanism (not depicted) provided in the door remote from the handle assembly and proximate an inside edge of the door (so as to be able to engage a latch pin or similar catch disposed on the door frame).

Of course, it is contemplated by the inventor hereof, and those skilled in the art will appreciate, that the present invention may be implemented in door handle assemblies other than as exemplified herein. For instance, and without limitation, the door handle assembly of which the present invention comprises a subassembly may operatively connect the release handle and latch mechanism via any conventional means, including, by way of example only, a latch rod, cables, electromechanical means, etc.

Figure 5:
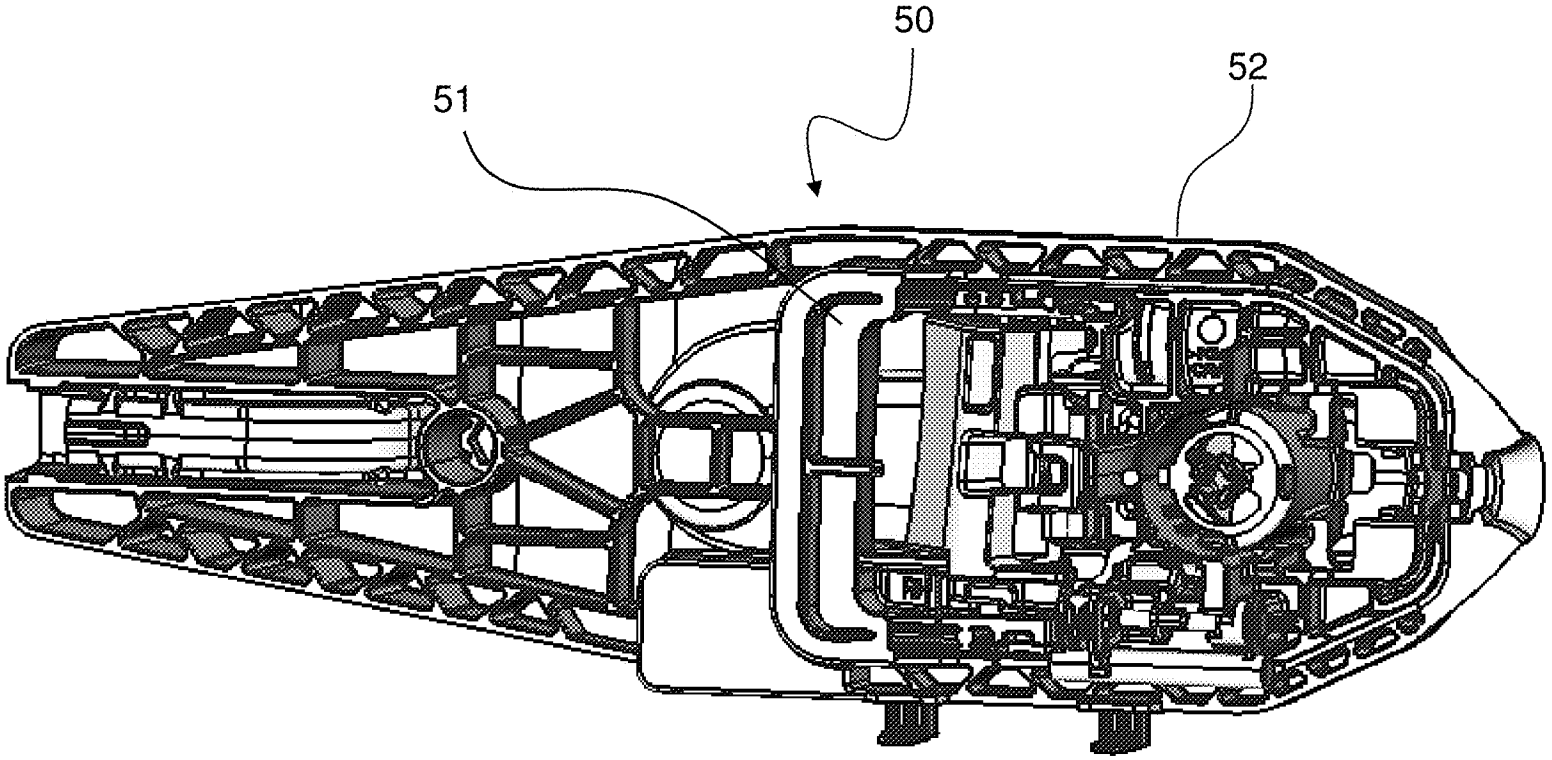
FIG. 5 is a perspective view of the release handle, bell crank actuator and inertial blocking member components of a release handle assembly according to the present disclosure, all depicted being mounted on a release handle framework.
Figure 6:
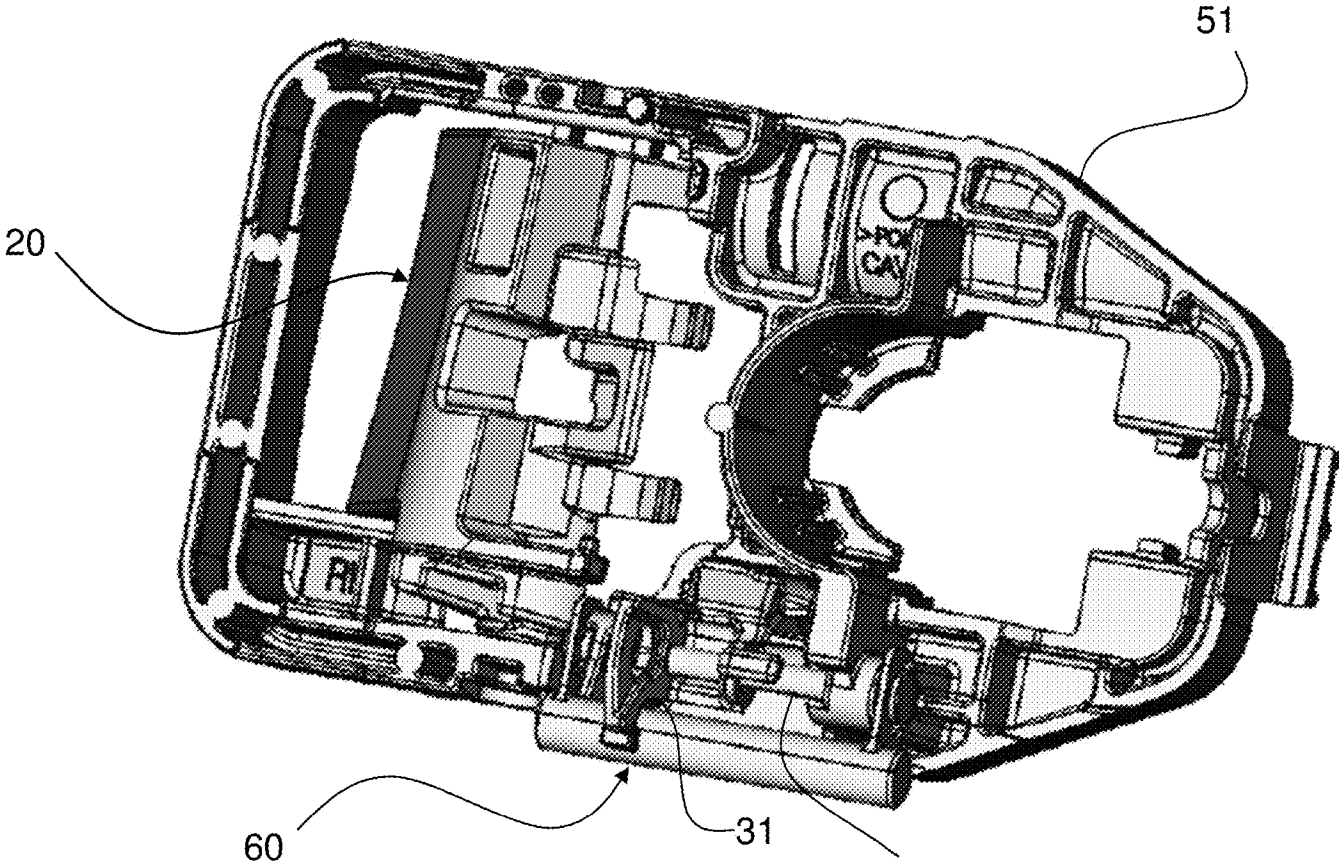
FIG. 6 is a perspective view of a part of the release handle framework supporting the bell crank actuator and inertial blocking member components.

With reference also being had to FIGS. 5 and 6, each of the release handle 16 and bell crank actuator 20, as well as the inertial blocking member subassembly 30 described further below, are supported on a release handle framework 50 mounted within the body of the door. That release handle framework may comprise a monolithic element or, as depicted, a multi-part element including a first part 51 coupled to a second part 52. According to the exemplary embodiment, the bell crank actuator 20 and inertial blocking member subassembly 30 are both movably mounted on the first part 51, as best shown in FIG. 6. Of course, the particular construction of the release handle framework 50, not comprising part of the present invention, may be varied according to the particular application.

The illustrated door handle assembly 15, which comprises a "strap"-type release handle, is but one example of a release handle assembly that can incorporate an inertial blocking member subassembly according to the present invention. It will be understood, with the benefit of this disclosure, that the present invention can alternatively be incorporated into other release handle assemblies, such as, by way of non-limiting example, paddle-type or twist-type handle assemblies.

Figure 11:
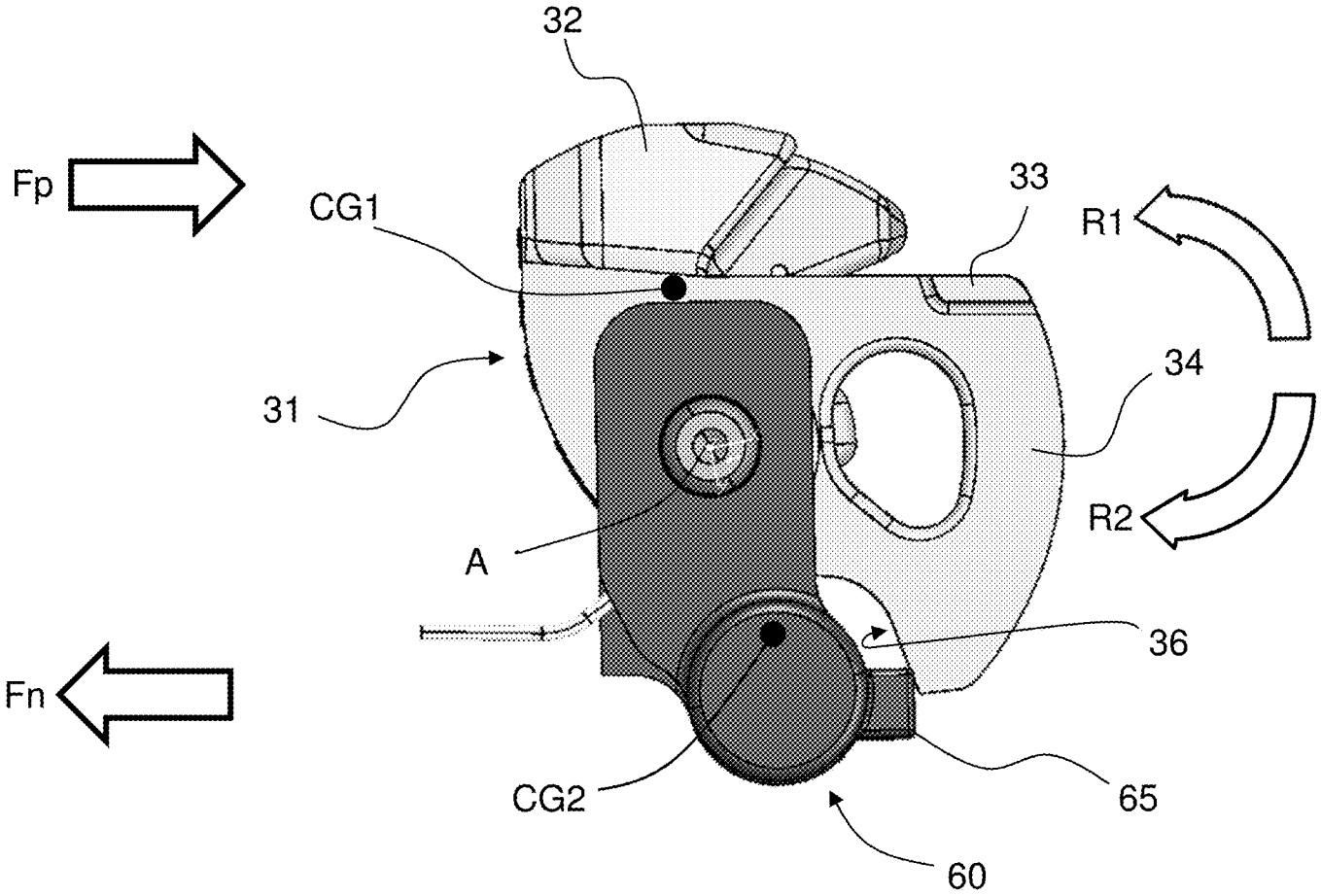
FIG. 11 is an end-view of the isolated blocking member accelerator and blocking member of the inertial blocking member subassembly.
Figure 12A:
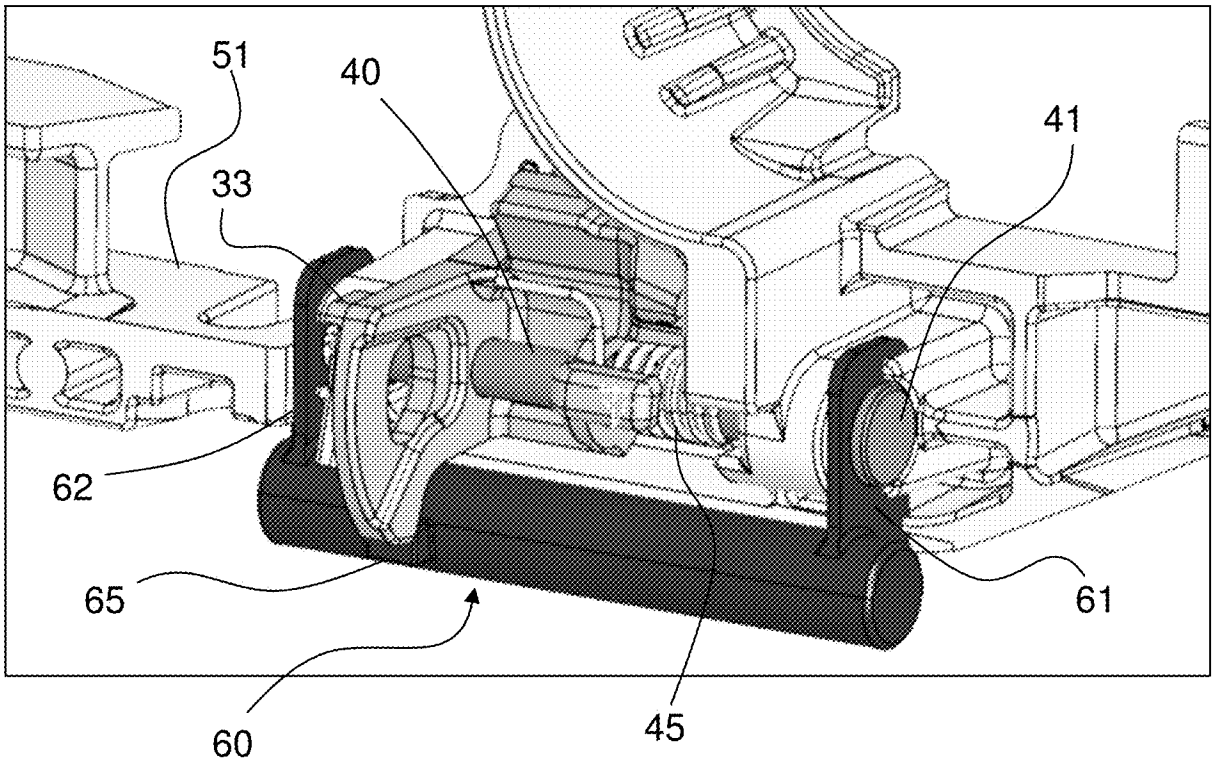
FIG. 12*a* is a detailed, right-hand perspective view of the blocking member subassembly in the at-rest position of the blocking member and blocking member accelerator.
Figure 12B:
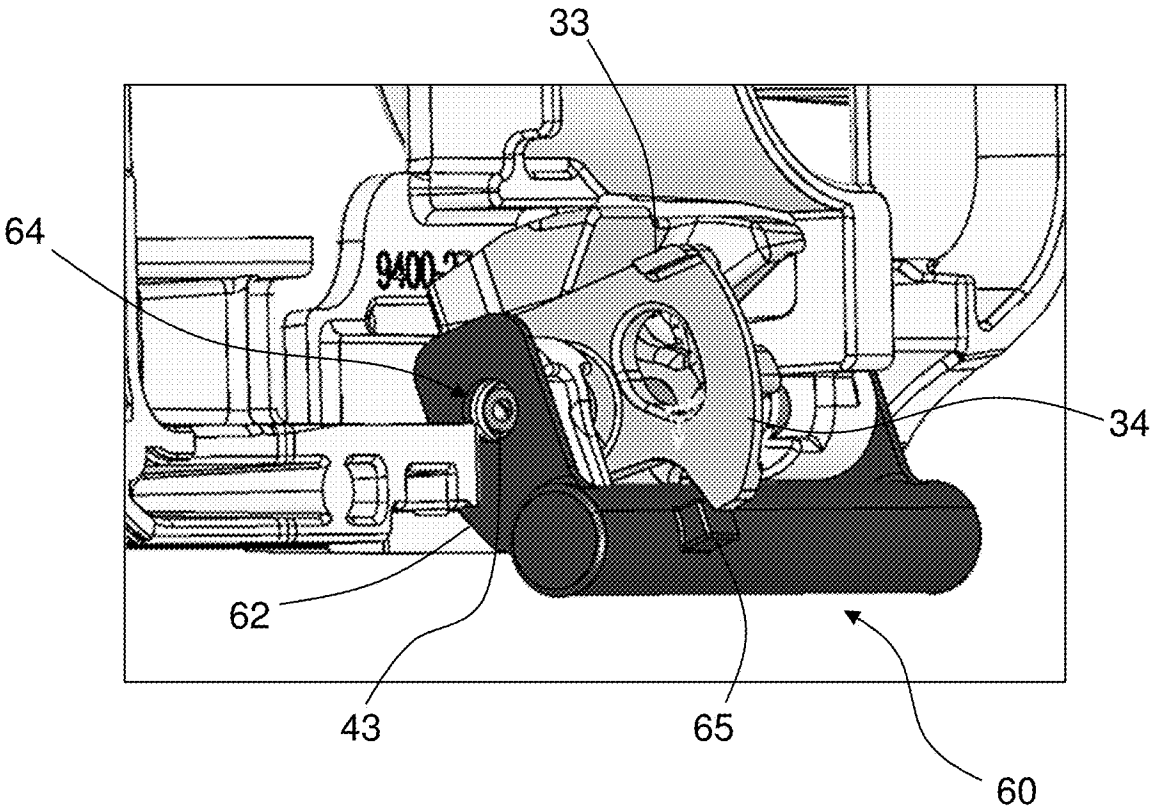
FIGS. 12*b* and 12*c* are detailed, left-hand perspective views of the blocking member subassembly in states of the blocking member and blocking member accelerator intermediate of the at-rest position and the engaged position of the blocking member.
Figure 12D:
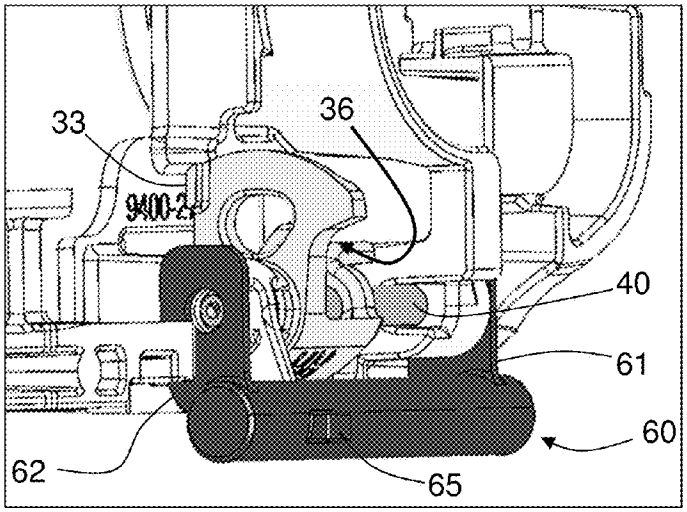
FIG. 12*d* is a detailed, left-hand perspective view of the blocking member subassembly showing the blocking member in the engaged position.
Figure 12C:
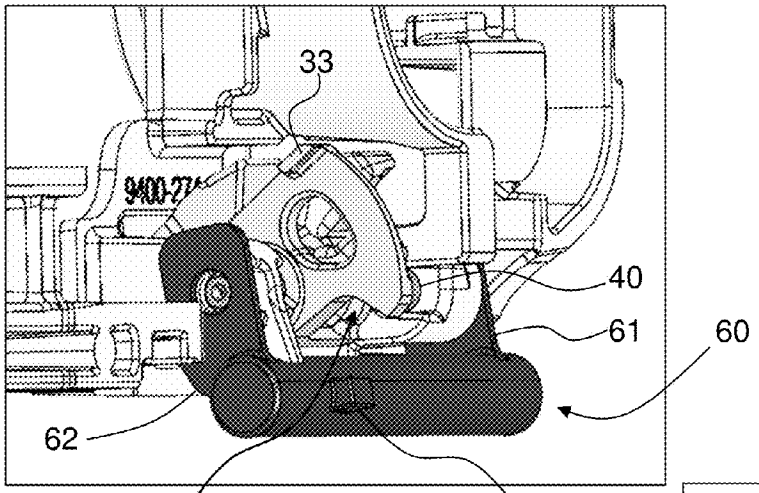

With particular reference being had to FIGS. 7 through 12*d*, the inertial blocking member subassembly 30 comprises a blocking member 31 mounted on a pin or axle 40 and freely rotatable thereon between a first, at-rest position (shown in FIG. 12*a*) and a second, engagement, or blocking, position (shown in FIG. 12*d*). As best depicted in FIGS. 8 through 12*d*, pin or axle 40 extends through, and is held in place by, opposite support features 52 and 53 formed as part of the release handle framework first part 51.

Figure 9:
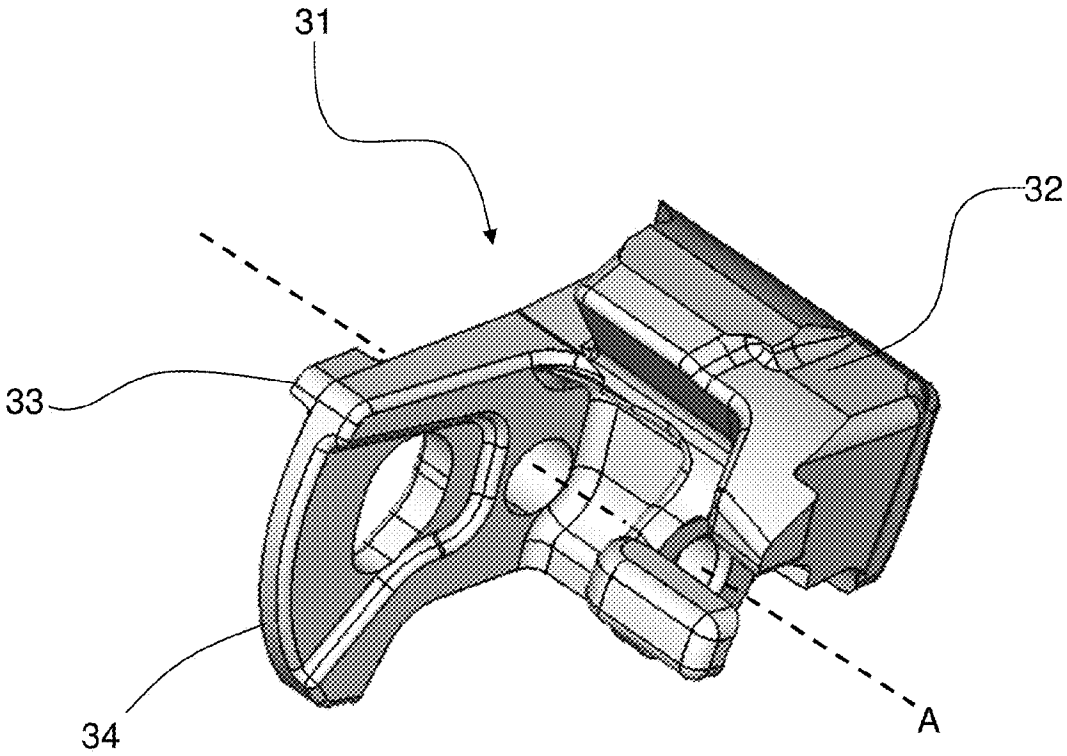
FIG. 9 is a detailed perspective view of the isolated blocking member component of the inertial blocking member subassembly.
Figure 10:
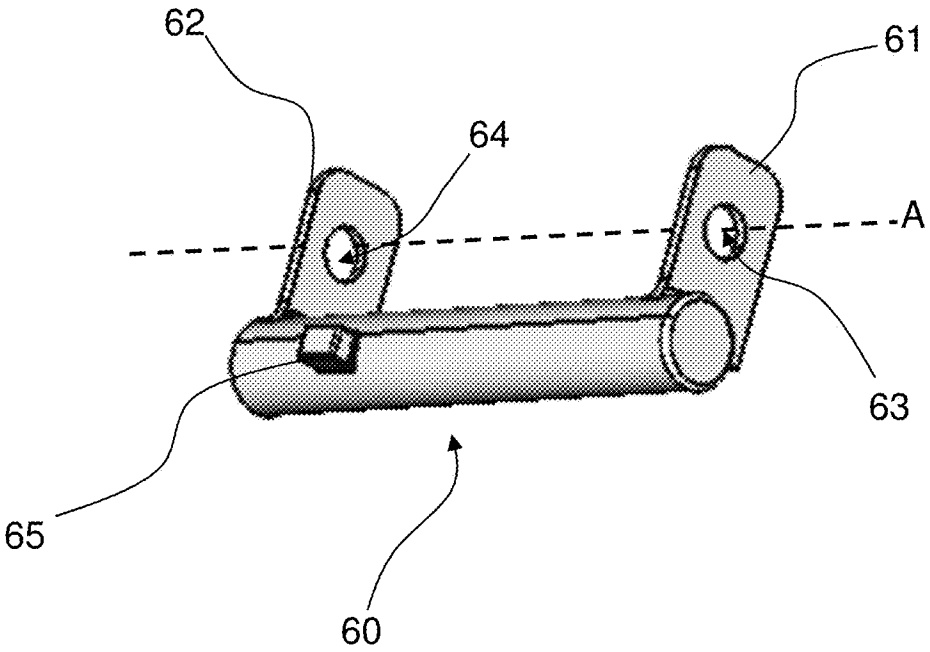
FIG. 10 is a detailed perspective view of the isolated blocking member accelerator body of the inertial blocking member subassembly.

As shown best in FIGS. 9 and 11, blocking member 31 is generally characterized by a shape including a counterweight portion 32 defining a mass offset from the rotational axis A, thus giving the blocking member 31 a center of gravity CG1 which is offset from the rotational axis A.

Figure 7:
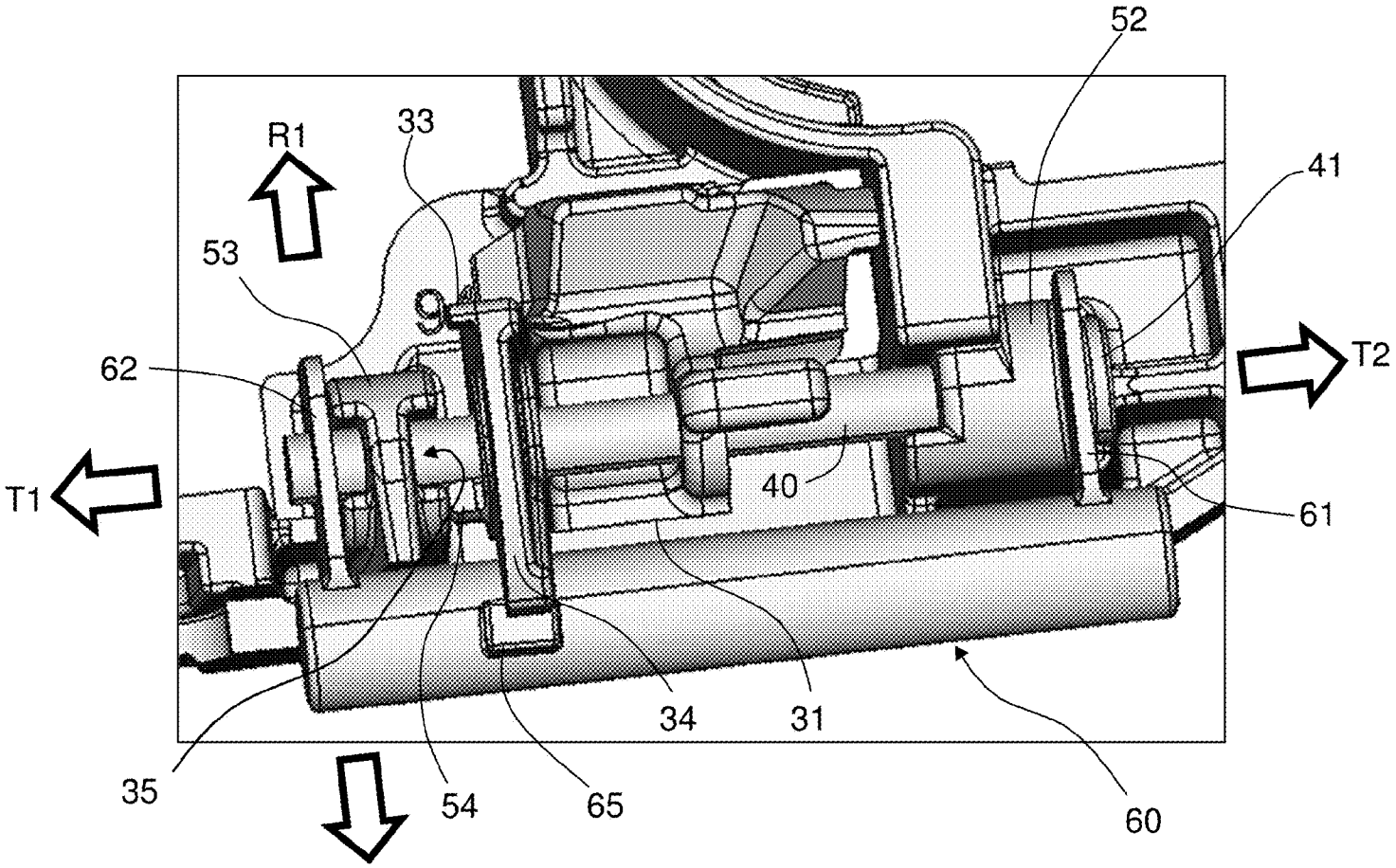
FIG. 7 is a detailed perspective view of FIG. 6, depicting more particularly the various components of the inertial blocking member subassembly.
Figure 8:
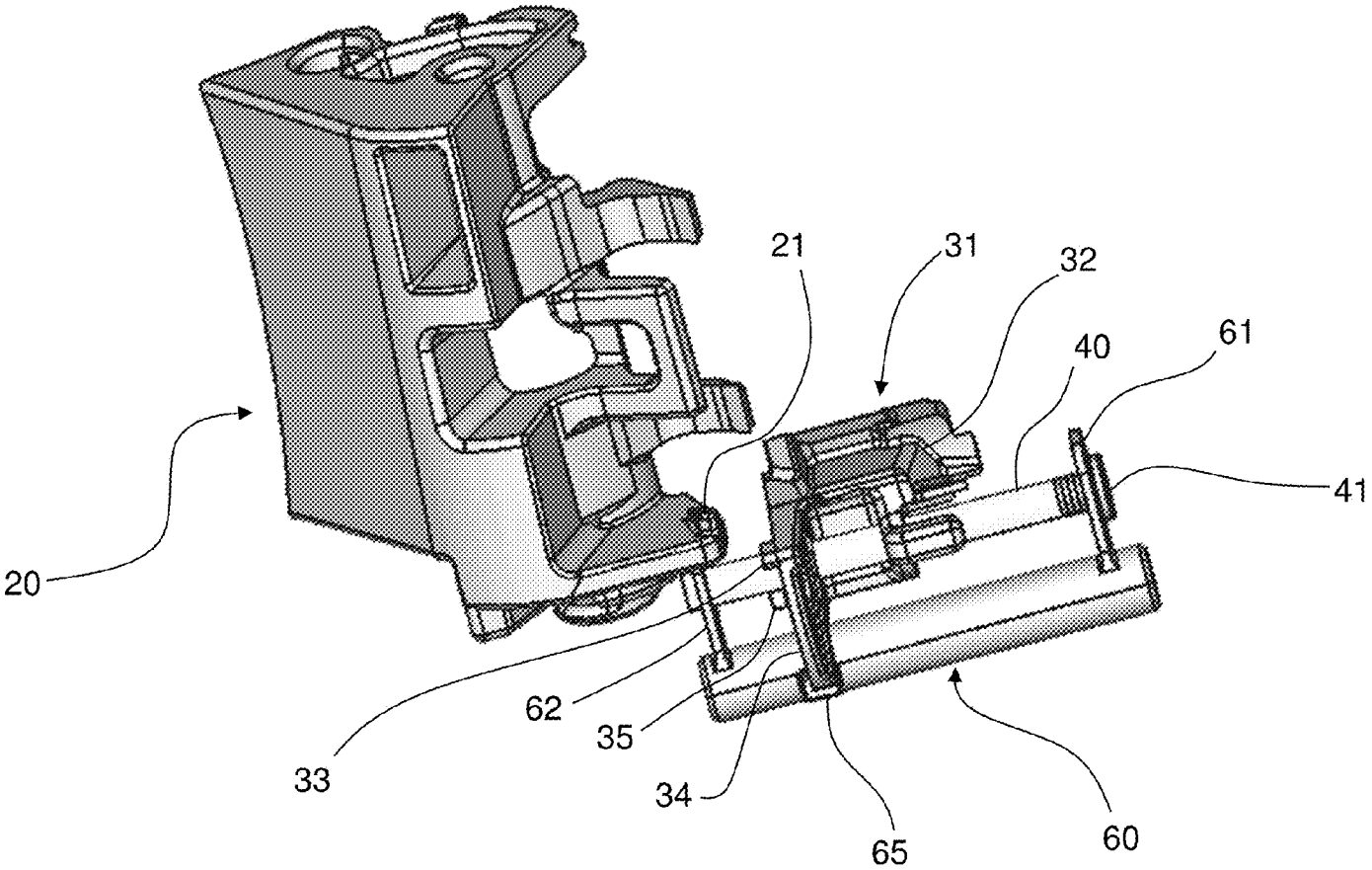
FIG. 8 is perspective view of the isolated bell crank actuator and blocking member subassembly components.

The blocking member 31 is, more particularly, movable in rotational (shown by the arrows R1 and R2) and translational (shown by the arrows T1 and T2, coaxial with the rotational axis A, in FIG. 7) directions between the at-rest position, in which the blocking member 31 does not prevent actuation of the release handle, and a blocking, or engaged, position, in which the blocking member 31 prevents actuation of the release handle. Still more particularly, the blocking member 31 includes an interference portion 33 which extends into the path of travel, and contacts an interference finger 21, of bell crank actuator 20 in the engaged or blocking position of the blocking member 31 to thereby prevent rotation of the bell crank actuator 20 and, correspondingly, movement of the associated release handle 16 and latch rod. Conversely, the blocking member 31 permits activation of the bell crank actuator 20 when the blocking member 31 is in the at-rest position, due to the fact that the interference portion 32 is not positioned in the path of travel of the interference finger 21.

According to the illustrated embodiment, counterweight portion 32 may be seen to take the form of an irregularly-shaped portion extending radially away from the axis of rotation A of the blocking member 31. Optionally, the blocking member may be characterized in that the counterweight portion 35 is designed to have a "hidden CG feature," such as described herein US Published Application 20100207404, the disclosure of which is hereby incorporated herein by reference in its entirety. To the extent that such a hidden CG feature is employed, it will be appreciated from the description of US Published Application 20100207404 that the blocking member 31 is configured so that, in the engaged position thereof, the center of gravity CG1 of the blocking member is approximately aligned with the vector of the positive acceleration force Fp and the axis of rotation A of the blocking member 31.

Optionally, a blocking member retainer may be provided on at least one of the release handle framework 50 and the blocking member 31, including, for instance, as described in the disclosure of US Published Application 20100207404. In the illustrated embodiment, the blocking member retainer comprises each of a projection provided on one of the release handle framework 50 or the blocking member 31, and a recess provided on the other of the release handle framework 50 or the blocking member 31. The projection is at least partially received in the recess in the engaged position of the blocking member 31. More particularly according to the illustrated embodiment, the blocking member 31 includes, at a first end thereof, a shelf or planar portion 34 extending radially away from the rotational axis A. Planar portion 34 defines an upper surface disposed in opposition to the support feature 53. Extending from upper surface toward the support feature 53 there is provided on the blocking member 31 an engagement feature 35. Engagement feature 35 is dimensioned to be received in cut-out or recess 54 defined in the support feature 53, as described further below. As shown, cut-out or recess 54 is defined in the support feature 53 at a position spaced from the position of the engagement feature 35 in the at-rest position of the blocking member 31. More particularly, the cut-out or recess 54 is positioned along the rotational path of travel of the blocking member 31 so that, as described below, engagement feature 35 is received in recess 54 in the engaged position of the blocking member.

Captured between the support feature 52 and an opposing end of the blocking member 31 there is provided on the pin 40 a biasing element or member 45. The biasing element 45 biases the blocking member 31 into the engaged, or blocking, position thereof. In the illustrated embodiment, the biasing element 45 comprises a helical torsion spring, although it is contemplated that other biasing elements, including other types of springs, may be substituted. According to the illustrated embodiment, the helical torsion spring is under longitudinal compression (i.e., along axis A) in the at-rest position of the blocking member 31, and so will be understood to bias the movement of the blocking member 31 translationally into the engaged position. When the blocking member 31 is in the engaged position, on the other hand, the rotational movement of the blocking member 31 from the at-rest to the engaged positions unwinds the helical torsion spring 45 to the point where it is biased in the direction of rotation of arrow R2 and, therefore, tends to urge the blocking member 31 back toward the at-rest position.

With continued reference to FIGS. 7 through 12*d*, the inertial blocking member subassembly 30 according to the present invention further includes a blocking member accelerator in the form, according to the illustrated embodiment, of a body 60 freely rotationally mounted relative to the blocking member 31. The accelerator body 60 has a center of gravity CG2 offset from both the axis of rotation A and center of gravity CG1 of the blocking member 31. The body 60 is, as described in more detail further herein, freely rotationally movable in response to a negative acceleration force, in consequence of which the body 60 is rotationally moved from the at-rest position (shown best in FIGS. 11 and 12*a*) to carry the blocking member 31 towards the engaged, or blocking, position thereof.

Accelerator body 60 according to the exemplary embodiment is a generally cylindrically-shaped member, manufactured from metal or other material imparting sufficient mass to the body 60 for its intended purpose. At opposite longitudinal ends body 60 includes arms 61, 62 projecting radially outwardly in the same direction. Each arm 61, 62 includes one of coaxial openings 63, 64 (respectively) therethrough which is dimensioned to receive the pin or axle 40. As shown, the distance between each arm 61, 62 is such that the blocking member 31 is disposed between the arms 61, 62. A first end of the pin or axle 40 may include an integral head 41 of larger diameter than the opening 63, while the second end of the pin or axle 40 may receive a locking washer 43 thereover after the accelerator body 60 is mounted thereon, the washer 43 being of greater diameter than the opening 64 to thereby retain the body 60 on the pin or axle 40.

Accelerator body 60 includes a projection 65 along its principal length, the projection 65 extending outwardly from the surface of the body 60. Projection 65 is positioned along the principal length of accelerator body 60 so as to abut an opposing portion of blocking member 31. More particularly, blocking member 31 includes a planar portion 34 extending radially away from the rotational axis A. Planar portion 34 has a peripheral edge that curves inwardly to define a contact surface 36 for the projection 65.

Referring specifically to FIGS. 11 through 12*d*, operation of the present invention may be better understood.

Figure 1:
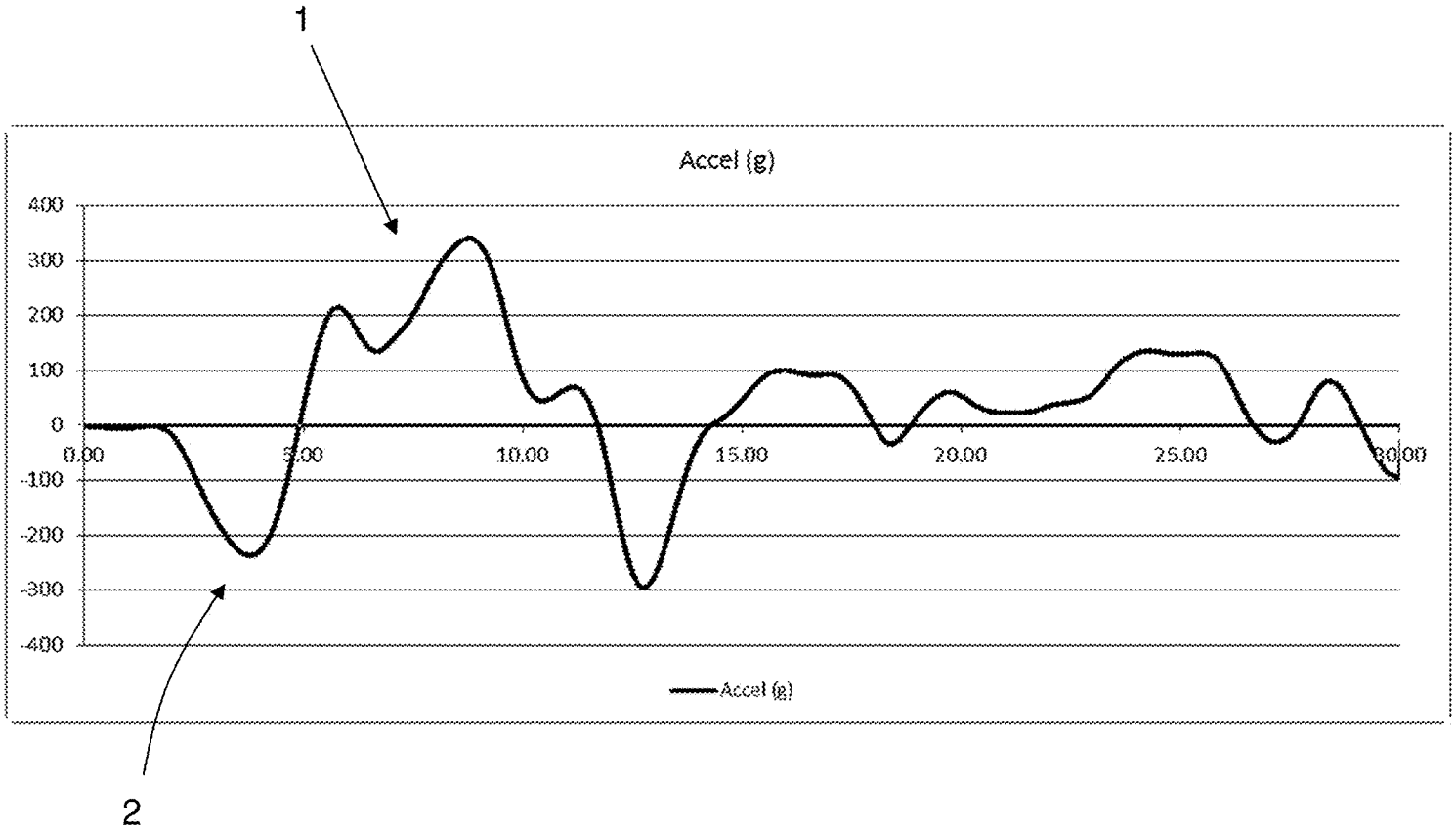
FIG. 1 PRIOR ART
FIG. 1 is a graph depicting the negative and positive acceleration components associated with an exemplary impact event.

As described heretofore, blocking member 31 will, in response to a sufficient positive acceleration force Fp acting on the blocking member 31 center of gravity CG1, be moved from the at-rest position (FIG. 12*a*) to the engaged position (FIG. 12*d*), in which engaged position the blocking member 31 prevents actuation of the release handle by interfering with the normal rotational movement of the bell crank actuator 40. As noted, however, blocking member 31 only responds to the onset of a sufficient positive acceleration force, and so will not move into the engaged position from the at-rest position in response to the negative acceleration force characterizing the initial phase of acceleration following an impact event (see FIG. 1). By reason of its configuration and disposition relative to the blocking member 31, however, accelerator body 60 is urged to rotate, in the direction of the arrow R1, by the negative acceleration force Fn. Being in contact with the blocking member 31 at the abutment of projection 65 and contact surface 35, as described above, accelerator body 60 carries with it the blocking member 31 as it rotates freely in the direction of the arrow R1 (it will be appreciated that, to this end, the mass of accelerator body 60 must be sufficient, under the circumstances, to overcome the mass of the blocking member 31 and any biasing force of the spring 45 or other biasing member that may be in opposition to rotational movement of the accelerator body 60.

During the course of rotational movement of the accelerator body 60, the positive acceleration phase of the impact event will ideally have commenced, such that a sufficient positive acceleration force Fp will act on the blocking member 60 to effect continued rotational movement thereof into the engaged, or blocking, position. Likewise, it will be understood that the accelerator body 60 will rotate back to its at-rest position as the negative acceleration force Fn dissipates and the positive acceleration force Fp commences.

Still more particularly, as a result of the positive acceleration force Fn acting on the blocking member center of gravity CG1, the blocking member 31 is rotationally (in the direction of the arrow R1) and translationally (in the direction of the arrow T1) moved from the at-rest position into the engaged position. More specifically, the positive acceleration force causes rotational movement of the blocking member 31 in the direction of the arrow R1. As blocking member 31 rotates, engagement feature 35 is moved from its at-rest position and into the cut-out or recess 54. As engagement feature 35 begins to enter the recess 54, biasing element 45 is able to urge blocking member 30 translationally, in the direction of arrow T1, toward the support feature 53, thereby bringing engagement feature 35 fully into recess 54.

By reason of the blocking member retainer, the blocking member 31 is retained in the engaged position until disengagement of the blocking member retainer from the at least one of the release handle assembly framework 50 and the blocking member 30. More particularly, it can be seen that the engagement feature 35 is maintained within the recess 54 both by reason of the biasing element 45, which urges the blocking member into the engaged position in the translational direction of arrow T1, and by reason of the confrontational engagement of the engagement feature 35 with the end-wall of recess 54, which prevents rotational movement of the blocking member in the direction of arrow R2 (i.e., back to the at-rest position).

Disengagement of the blocking member retainer from the at least one of the release handle assembly framework and the blocking member may be effected by operating the release handle assembly (not shown). More particularly, pulling on the door handle grip (not shown) can rotate the interference finger 21 of the bell-crank assembly downwardly against the interference portion 33 of the blocking member 31, thereby moving the blocking member in the direction of the arrow T2. This motion will bring the engagement feature 35 out of recess 54. Once the engagement feature 35 has cleared the cut-out or recess 54, the bias in helical torsion spring 45 will tend to urge the blocking member rotationally in a direction of arrow R2 and back into the at-rest position. Concurrently, continued downward movement of the interference finger 21 will move the blocking member downwardly in the direction of arrow T2 to compress the helical torsion spring 45 until, when the blocking member is fully rotated into the at-rest position, further engagement between the interference finger 21 and interference portion 33 is prevented as the interference portion 33 is moved rotationally out of the path of the interference finger 21. Thus, it will be understood that, through the combined action of actuation of the door handle grip and the bias of the helical torsion spring, the blocking member engagement feature 35 is disengaged from the recess 54 and, concurrently, the blocking member is returned to the at-rest position.

By the foregoing construction and operation, it will be appreciated that the present invention provides a mechanism that is at once simple in construction yet effective to accelerate movement of a release handle assembly's inertial blocking member into the engaged, or blocking, position thereof during the negative acceleration phase of a vehicle impact event.

It will also be appreciated that the inertial blocking member subassembly described and illustrated herein can be readily utilized in vehicle door release handle assemblies. Modest modifications to the release handle assembly and the inertial blocking member subassembly can be developed to enable the release handle assembly to be incorporated into virtually any vehicle. The inertial blocking member subassembly comprises a minimum of components, thereby optimizing the repeatability and effectiveness of the safety action, and minimizing fabrication and installation costs. The inertial blocking member subassembly can be incorporated into a release handle assembly for movement about a horizontal axis or a vertical axis. In either configuration, the inertial blocking member subassembly engages during the acceleration phase, and engagement continues into and after the deformation phase of an impact event to maintain the door handle grip in a disabled condition until all acceleration forces have dissipated and/or the release handle is pulled by a user.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

The invention in which an exclusive property or privilege is claimed is defined as follows:

1. An inertial blocking member subassembly for a vehicle-door release handle mechanism including a release handle framework supporting a bell crank actuator and a manually actuatable door handle grip, the door handle grip operatively coupled to the bell crank actuator, the inertial blocking member subassembly comprising:

an inertial blocking member associated with the release handle assembly framework, the blocking member having a mass defining a center of gravity which is offset from an axis of rotation, and the blocking member being rotationally and/or translationally movable between an at-rest position, in which the blocking member does not prevent actuation of the release handle, and an engaged position, in which the blocking member prevents actuation of the release handle;

a discrete accelerator body freely mounted relative to the inertial blocking member for rotational movement about the axis of rotation, the accelerator body having a mass defining a center of gravity which is offset from both the axis of rotation and center of gravity of the inertial blocking member;

whereby, as a result of a negative acceleration force acting on the accelerator body center of gravity, the accelerator body rotates about the axis of rotation and carries the blocking member toward the engaged position thereof;

whereby, as a result of the negative acceleration force acting on the blocking member, the blocking member does not independently move toward the engaged position thereof; and whereby, as a result of a positive acceleration force acting on the blocking member center of gravity, the blocking member is rotationally and/or translationally moved into the engaged position thereof.

2. The inertial blocking member subassembly of claim 1, wherein, in the engaged position of the blocking member, the center of gravity of the blocking member is approximately aligned with a vector of the positive acceleration force and the axis of rotation of the blocking member.

3. The inertial blocking member subassembly of claim 1, wherein the blocking member intercepts and prevents activation of the bell crank actuator when the blocking member is in the engaged position, and permits activation of the bell crank actuator when the blocking member is in the at-rest position.

4. The inertial blocking member subassembly of claim 3, wherein the blocking member includes an interference portion which extends into the path of travel, and contacts an interference finger, of bell crank actuator in the engaged or blocking position of the blocking member to thereby prevent rotation of the bell crank actuator.

5. The inertial blocking member subassembly of claim 1, further comprising a blocking member retainer provided on at least one of the release handle framework and the blocking member, and wherein, by reason of the blocking member retainer, the blocking member is retained in the engaged position until disengagement of the blocking member retainer from the at least one of the release handle assembly framework and the blocking member.

6. The inertial blocking member subassembly of claim 5, wherein the blocking member retainer comprises each of a projection provided on one of the release handle framework or the blocking member, and a recess provided on the other of the release handle framework or the blocking member, the projection being at least partially received in the recess in the engaged position of the blocking member.

7. The inertial blocking member subassembly of claim 6, wherein disengagement of the blocking member retainer from the at least one of the release handle assembly framework and the blocking member is effected by operating the release handle assembly.

8. The inertial blocking member subassembly of claim 7, further comprising a biasing member biasing the blocking member into the engaged position thereof, and wherein disengagement of the blocking member retainer from the at least one of the release handle assembly framework and the blocking member may be effected by operating the release handle assembly and, through the combined action of actuation of the door handle grip and the bias of the helical torsion spring, the blocking member engagement feature is disengaged from the recess and, concurrently, the blocking member is returned to the at-rest position.

9. The inertial blocking member subassembly of claim 1, further comprising a biasing member biasing the blocking member into the engaged position thereof.

10. The inertial blocking member subassembly of claim 9, wherein the biasing member comprises a helical torsion spring.

11. The inertial blocking member subassembly of claim 1, wherein the blocking member is mounted on a pin or axle and freely rotatable thereon between the at-rest position and the engaged position.

12. The inertial blocking member subassembly of claim 11, wherein the pin or axle extends between opposite support features provided on the release handle framework.

13. The inertial blocking member subassembly of claim 1, wherein the blocking member is movable in both rotational and translational directions between the at-rest position and the engaged position.

14. The inertial blocking member subassembly of claim 13, wherein the accelerator body includes arms projecting radially outwardly in the same direction, each arm having one of coaxial openings which are dimensioned to receive the pin or axle therethrough.

15. The inertial blocking member subassembly of claim 14, wherein the accelerator body is a generally cylindrically-shaped member.

16. The inertial blocking member subassembly of claim 1, wherein the blocking member accelerator body includes a projection along its principal length, the projection extending outwardly from the surface of the body and positioned so as to abut an opposing portion of the blocking member.

17. The inertial blocking member subassembly of claim 16, wherein the blocking member includes a planar portion extending radially away from the rotational axis thereof, the planar portion having a peripheral edge that curves inwardly to define a contact surface for the projection when, as a result of a negative acceleration force acting on the accelerator body center of gravity, the accelerator body rotates about the axis of rotation and carries the blocking member toward the engaged position thereof.

18. An inertial blocking member subassembly for a vehicle-door release handle mechanism including a release handle framework supporting a bell crank actuator and a manually actuatable door handle grip, the door handle grip operatively coupled to the bell crank actuator, the inertial blocking member subassembly comprising:

an inertial blocking member associated with the release handle assembly framework, the blocking member having a mass defining a center of gravity which is offset from an axis of rotation, and the blocking member being rotationally and/or translationally movable between an at-rest position, in which the blocking member does not prevent actuation of the release handle, and an engaged position, in which the blocking member prevents actuation of the release handle;

an accelerator body freely mounted relative to the inertial blocking member for rotational movement about the axis of rotation, the accelerator body having a mass defining a center of gravity which is offset from both the axis of rotation and center of gravity of the inertial blocking member;

whereby, as a result of a negative acceleration force acting on the accelerator body center of gravity, the accelerator body rotates about the axis of rotation and carries the blocking member toward the engaged position thereof;

whereby, as a result of a positive acceleration force acting on the blocking member center of gravity, the blocking member is rotationally and/or translationally moved into the engaged position thereof;

wherein the blocking member is movable in both rotational and translational directions between the at-rest and the engaged position; and wherein the accelerator body includes arms projecting radially outwardly in the same direction, each arm having one of coaxial openings which are dimensioned to receive the pin or axle therethrough.

19. The inertial blocking member subassembly of claim 18, wherein the accelerator body is a generally cylindrically-shaped member.

* * * * *